US011498717B2

(12) United States Patent
Jung et al.

(10) Patent No.: US 11,498,717 B2
(45) **Date of Patent: *Nov. 15, 2022**

(54) GLASS BOTTLE FOR CONTAINING LIQUID

(71) Applicant: Kyung Hwa Kim, Seoul (KR)

(72) Inventors: Kyung Il Jung, Seoul (KR); Youngtack Shim, Seoul (KR)

(73) Assignee: Kyung Hwa Kim, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/245,943

(22) Filed: Apr. 4, 2014

(65) Prior Publication Data

US 2014/0217055 A1 Aug. 7, 2014

Related U.S. Application Data

(63) Continuation of application No. 13/759,980, filed on Feb. 5, 2013, now Pat. No. 8,714,385, which is a continuation of application No. 13/464,158, filed on May 4, 2012, now abandoned, which is a continuation-in-part of application No. 12/741,869, filed as application No. PCT/KR2008/007261 on Dec. 9, 2008, now abandoned.

(30) Foreign Application Priority Data

Dec. 5, 2008 (KR) ..... 10-2008-0123344

(51) Int. Cl.
*B65D 1/02* (2006.01)
*B65D 23/04* (2006.01)

(52) U.S. Cl.
CPC ..... *B65D 1/0223* (2013.01); *B65D 1/023* (2013.01); *B65D 1/0207* (2013.01); *B65D 1/0292* (2013.01); *B65D 23/04* (2013.01); *B65D 2501/0045* (2013.01)

(58) Field of Classification Search
CPC .. B65D 81/3886; B65D 25/34; B65D 1/0223; B65D 1/0207; B65D 1/023; A61G 5/10; B62D 1/06; E04G 21/30
USPC ..... 215/382, 379, 384, 40, 366, 381, 46; 220/669, 666, 673, 675, 667; 65/78, 79; 222/104, 473, 92; D9/500, 516, 527, D9/538, 550, 552, 563, 724
See application file for complete search history.

(56) References Cited

U.S. PATENT DOCUMENTS 31,046 A * 1/1861 Whitney ..... B65D 39/08 215/356
D74,499 S 12/1926 Ginter
3,946,903 A 3/1976 Paker
(Continued)

FOREIGN PATENT DOCUMENTS

JP 09-138559 A 5/1997
JP 09-156624 A 6/1997
(Continued)

*Primary Examiner* — Stephen J Castellano
(74) *Attorney, Agent, or Firm* — Edwin A. Sisson, Attorney at Law, LLC; Jeffrey J. Banyas

(57) ABSTRACT

Disclosed is a bottle for containing liquid content including a body portion, at least part or the entire portion of an upper portion of which is provided with a plurality of guides which protrudes inward from an inside surface thereof and is in a spiral pattern so that the liquid content can be guided towards an opening of a neck portion of the bottle while spirally revolving inside the bottle.

24 Claims, 4 Drawing Sheets

(56) References Cited

U.S. PATENT DOCUMENTS

| | | | | |
|---|---|---|---|---|
| D286,021 | S | 10/1986 | O'Reilly | |
| 5,593,056 | A | 1/1997 | Mero et al. | |
| 5,833,115 | A * | 11/1998 | Eiten | B65D 1/0223 215/382 |
| 6,666,001 | B2 | 12/2003 | Mero | |
| 7,604,140 | B2 | 10/2009 | Pritchett, Jr. et al. | |
| 2004/0069740 | A1 | 4/2004 | Athalye | |
| 2006/0108318 | A1 | 5/2006 | Chisholm | |
| 2006/0207961 | A1 * | 9/2006 | Kurtz | B65D 1/0223 215/382 |
| 2010/0072167 | A1 | 3/2010 | Dickie | |
| 2010/0140294 | A1 | 6/2010 | Bourguignon et al. | |
| 2010/0219189 | A1 | 9/2010 | Buttigieg | |
| 2010/0264107 | A1 * | 10/2010 | Lonsway | B65D 1/023 215/40 |
| 2010/0270260 | A1 | 10/2010 | Jung | |

FOREIGN PATENT DOCUMENTS

| | | | |
|---|---|---|---|
| JP | 2007-8536 | A | 1/2007 |
| JP | 3953698 | B2 | 8/2007 |
| KR | 20-2001-0027665 | Y1 | 12/2001 |
| KR | 10-0916631 | B1 | 9/2009 |
| KR | 10-2010-0065058 | A | 6/2010 |
| WO | 2010/064749 | A1 | 6/2010 |

* cited by examiner

GLASS BOTTLE FOR CONTAINING LIQUID

This application is a continuation of Ser. No. 13/759,980 filed on 5 Feb. 2013, now U.S. Pat. No. 8,714,385, which is a continuation of Ser. No. 13/464,158 filed on 4 May 2012, now abandoned, which is a continuation-in-part of Ser. No. 12/741,869 filed on 7 May 2010, now abandoned, which is the national stage (Rule 371) of international application No. PCT/KR2008/007261 filed on 9 Dec. 2008 and claims foreign priority benefit to Korean application No. KR10-2008-0123344 filed 5 Dec. 2008.

BACKGROUND

Field

The present invention relates to a bottle for containing liquid contents therein, and more particularly to a bottle which can stably discharge liquid contents through an opening by making the contained liquid contents smoothly flow along a plurality of guides arranged in a spiral pattern.

Description of Related Technology

At present, beverages, such as water and colas, liquors, or liquid-type food, are contained in various kinds of containers. Examples of such liquid containers are paper bottles, PET bottles, glass bottles, and metal bottles (aluminum cans).

Of these containers, the PET bottle is the most popular liquid container thanks to its many advantages, such as that it can contain contents for a relatively long time, i.e. contents in the PET bottle barely decay after a long time of storage because gas transmittance of the PET bottle is very low compared with other kinds of containers, it hardly breaks when it is dropped in a state in which it is filled with contents, it does not produce broken pieces even when it is ruptured, and it is convenient to carry and keep the PET bottle because the PET bottle is lighter than a glass bottle.

The known PET bottle having the above advantages is generally composed of a neck portion which has an opening at an end and threads on an outer surface thereof for sealing when the neck portion is combined with a cover, and a body portion extending from the neck portion and containing contents therein. The body portion may be of various sizes and forms according to the type of contents.

There are ways of discharging the contents of the PET bottle. For example, when a user tilts the PET bottle to pour the contents into a vessel, such as a cup, or to directly drink the contents from the PET bottle, the contents are discharged from the PET bottle.

In such a case, there is a possibility that the contents contained in the body portion of the PET bottle are not smoothly discharged but are abruptly discharged at excessive pressure, so that the contents are likely to gush out of the PET bottle and to splatter on a user's clothes or the surrounding area. In particular, when the user directly drinks the contents from the bottle, the user may choke or his or her clothes or body may get splashed.

Further, since the bottles have large volumes even when they are empty, it is difficult to deal with the empty bottles or it is required to install additional equipment in households to reduce the volume of the empty bottles.

SUMMARY

One aspect of the invention provides a bottle for containing liquid. The bottle comprises: a single-piece glass body comprising a base and a neck; the neck comprising a top end and a bottom end; the neck further comprising an inner surface that defines a channel between the top end and the bottom end; the base extending from the bottom end of the neck and comprising a liquid-containing space therein; and at least one inwardly-protruded spiral guide formed on the inner surface of the neck and configured to guide at least part of liquid to spirally flow through the channel when discharging liquid from the liquid-containing space, wherein the at least one inwardly-protruded spiral guide generally spirally extends about a central axis of the bottle that passes through the channel and the liquid-containing space.

In the bottle, in a cross-section taken in a plane parallel to the central axis, the at least one inwardly-protruded spiral guide provides multiple peaks and multiple valleys, which comprise a leading valley, a trailing valley and a first peak interposed between the leading valley and trailing valley, the trailing valley being located closer to the base than the leading valley, there being no intervening peak or valley between the first peak and the leading valley, there being no intervening peak or valley between the first peak and the trailing valley. In the cross-section, the first peak is defined with a leading slope, a trailing slope and a tip connecting the leading and trailing slope, the leading slope being defined between the tip of the first peak and the bottom of the leading valley, the trailing slope being defined between the tip of the first peak and the bottom of the trailing valley, wherein in the cross-section the leading slope is longer than the trailing slope.

In the foregoing bottle, in a cross-section taken in a plane parallel to the central axis, the at least one inwardly-protruded spiral guide provides multiple peaks and multiple valleys, wherein in the cross-section, the first peak is defined with a leading slope and a trailing slope, the trailing slope being closer to the base than the leading slope, the leading slope comprising a portion generally defined with a first radius of curvature, the trailing slope comprising a portion generally defined with a second radius of curvature, wherein in the cross-section the first radius of curvature is greater than the second radius of curvature. In the foregoing bottle, the single-piece glass body further comprises a rim at the top end of the neck, wherein the at least one inwardly-protruded spiral guide extends between the top end and the bottom end. In a cross-section taken in a plane parallel to the central axis the at least one inwardly-protruded spiral guide provides multiple peaks and multiple valleys, wherein two immediately neighboring ones of the multiple peaks have a generally uniform distance. Wherein the at least one inwardly-protruded spiral guide comprises two immediately neighboring peaks that generally spirally extend with a gap therebetween, wherein the gap is maintained generally uniformly over the extension thereof.

In the foregoing bottle, the at least one inwardly-protruded spiral guide is recognizable in a perspective view of the glass body from the outside. The neck comprises an outer surface and at least one depression on the outer surface that spirally extends and corresponds to the at least one inwardly-protruded spiral guide. With the presence of the at least one inwardly-protruded spiral guide, the neck comprises an undulating cross-sectional portion when the cross-section is taken in a plane parallel to the central axis. A cross-section of the base taken in a plane perpendicular to the central axis is generally in a circular shape and has an inner diameter, wherein the base has a level at which the inner diameter is the largest, wherein the at least one inwardly-protruded spiral guide does not extend to the level at which the inner diameter is the largest. The base comprises a portion in which the inner diameter of a cross-section of the base gradually increases along the central axis away from the neck.

In the foregoing bottle, a cross-section of the base taken in a plane perpendicular to the central axis is generally circular and has an inner diameter, wherein the base has a level at which the inner diameter is the largest, wherein the at least one inwardly-protruded spiral guide continuously extends from the top end of the neck to the base passing the level at which the inner diameter is the largest. The inner surface of the neck with the at least one inwardly-protruded spiral guide includes a general shape of a letter "C" or a reversed letter "C" in a cross-section taken in a plane parallel to the central axis. In any embodiments of the foregoing bottle, when viewed in the central axis, the at least one inwardly-protruded spiral guide runs around the central axis at an angle about 180° or more; about 270° or more; or about 360° or more.

Another aspect of the invention provides an article comprising: a bottle having one or more of the foregoing features; and liquid contained in the liquid-containing space of the base. A still further aspect of the invention provides a method of discharging liquid contained in a bottle. The method comprises: providing the foregoing article; tilting the bottle to discharge at least part of the liquid out of the bottle; wherein the at least one inwardly-protruded spiral guide causes at least part of the liquid to at least in part spirally flow along the at least one inwardly-protruded spiral guide when passing through the channel.

One aspect of the invention provides a bottle for containing liquid, which may comprise: a glass body comprising a cap-engaging portion, an outwardly-protruded rim portion, and a liquid containing portion; the cap-engaging portion defining an opening of the bottle and configured to engage with a bottle cap; the outwardly-protruding rim interposed between the cap-engaging portion and the liquid containing portion; the liquid containing portion comprising an upper portion and a lower portion, which together define a liquid-containing space therein; the upper portion comprising an upper end, a lower end and an upper inside surface, the upper end abutting the outwardly-protruded rim portion, the lower end abutting the lower portion; and the upper portion further comprising at least one inwardly-protruded spiral guide provided on the upper inside surface, the at least one inwardly-protruded spiral guide generally spirally extending from the upper end to the lower end and configured to guide therealong a flow of liquid toward the cap engaging portion when the bottle is tilted.

In the foregoing bottle, the at least one inwardly-protruded spiral guide may stop at the lower end of the upper portion, wherein no inwardly-protruded spiral guide provided in the lower portion. The lower end of the upper portion may be beyond the mid-point of the bottle's length. The upper portion may further comprise two or more inwardly-protruded spiral guides extending from the upper end. The upper body portion may be narrower at the upper end than at a lower end abutting the lower portion. The at least one inwardly-protruded spiral guide has a width, which may be maintained generally uniformly over extension thereof. The at least one inwardly-protruded spiral guide has a width, which may gradually increase over at least part of extension thereof in a direction from the upper end to the lower end. The at least one inwardly-protruded spiral guide of the upper portion may be recognizable in a perspective view of the bottle from outside.

Still in the foregoing bottle, the upper portion may comprise an outside surface, wherein the upper portion may further comprise at least one depression on the outside surface that spirally extends and correspond to the at least one inwardly-protruded spiral guide. With the presence of the at least one inwardly-protruded spiral guide, the upper portion may comprise an undulating cross-sectional portion when the cross-section may be taken in a central axis of the at least one inwardly-protruded spiral guide. The lower portion may comprise a lower inside surface, wherein the lower inside surface may comprise at least one inwardly-protruded spiral guide continuously extending the at least one inwardly-protruded guide of the upper portion. The inside surface and the at least one inwardly-protruded spiral guide of the upper portion have a general shape of a letter "C" or a reversed letter "C" in a cross-section taken in a plane parallel to a longitudinal direction of the bottle.

Another aspect of the invention provides an article comprising the above-described bottle and beverage contained in the liquid-containing space of bottle. Further another aspect of the invention provides a method of discharging liquid contained in a bottle, which comprises: providing the above-described bottle and liquid contained in the bottle; and tilting the bottle and discharging the liquid out of the bottle through the opening; wherein the liquid may be at least partly guided by the at least one inwardly-protruded spiral guide.

In the foregoing bottle, with the presence of the four or more inwardly-protruded spiral guide, the upper portion may comprise an undulating cross-section taken in a plane parallel to a central axis of the four or more inwardly-protruded spiral guides. The lower end of the upper portion may be beyond the mid-point of the bottle's length. Two of the four or more inwardly-protruded spiral guides form a gap therebetween, wherein the gap may be maintained generally the same over extension thereof. The upper body portion may be in a shape having two cross-sectional portions that are gradually diverging from each other from the upper end toward the lower end when the cross-section may be taken in a plane parallel to a central axis of the at least one inwardly-protruded spiral guide. The liquid-containing portion may comprise an outside surface, wherein the upper portion may further comprise four or more depressions on the outside surface that spirally extend and correspond to the four or more inwardly-protruded spiral guides. The presence of the at least one inwardly-protruded spiral guide, the upper portion may comprise an undulating cross-section taken in a plane parallel to a central axis of the four or more inwardly-protruded spiral guides.

A still further aspect of the invention provides a bottle for containing liquid, which comprises: a glass body comprising a cap-engaging portion, an outwardly-protruded rim portion, and a liquid containing portion; the cap-engaging portion defining an opening of the bottle and configured to engage with a bottle cap; the outwardly-protruding rim portion interposed between the cap-engaging portion and the liquid containing portion; the liquid containing portion defining a liquid-containing space therein and having a top and a bottom, the top abutting the outwardly-protruded rim portion; and the liquid containing portion comprising four or more inwardly-protruded spiral guides generally spirally extending from about the top of the liquid containing portion and stopping at a level between the top and bottom, wherein no inwardly-protruded spiral guide is provided between said level to the bottom.

In order to accomplish the above and other advantages there is provided, in one exemplary aspect of the invention a bottle for containing liquid contents including a body portion, at least part or the entire portion of an upper portion of which is provided with a plurality of guides which protrudes inwardly from an inside surface of the body portion in a spiral pattern so that the liquid contents can be guided toward an opening of a neck portion of the bottle while spirally revolving inside the bottle.

In another exemplary aspect of the invention, the entire body portion of the bottle is provided with the plurality of guides which protrudes inwardly from the inside surface of the bottle in a spiral pattern. In another exemplary aspect of the invention, a section of each of the plurality of guides has a shape of the letter 'C' or a reversed letter 'C' when each guide is cut across its width, and a curvature of each guide be uniform over a portion of its length or change in a manner such that a curve of a leading portion is relatively gentle and a curve of a back portion is relatively tight.

In another exemplary aspect of the invention, the plurality of guide lines have four or eight lines of spiral patterns. In another exemplary aspect of the invention, the bottle can be a paper bottle, a PET bottle, a metal bottle, or a glass bottle. In another exemplary aspect of the invention, each of the plurality of guides takes a form in which a width of a lower portion is larger than that of an upper portion. In another exemplary aspect of the invention, each of the plurality of guides has a uniform width at the upper portion and the lower portion.

As described above, according to another exemplary aspect of the invention, the bottle is provided with a plurality of guides having a spiral pattern winding around the body portion of the bottle so that liquid contents in the bottle can be stably guided toward and discharged through the opening of the bottle while spirally revolving inside the bottle. Since the abrupt gushing of the liquid content is prevented, it is possible to safely pour and drive the liquid contents from the bottle and to prevent splattering of the liquid contents attributable to the abrupt discharge of the liquid contents from occurring.

In the case in which the bottle is used to contain a beverage, such as water, cola, or juice, since the flow of the beverage is moderate, it is possible to prevent accidents such as the user choking. In the case in which the bottle is a PET bottle, it is possible to reduce the volume of the empty bottle by applying external force to the empty bottle after the contents have been emptied so that the bottle is twisted as the plurality of guides is compressed. Accordingly, it is easy to dispose and recover the empty bottles.

It is an advantage of some of the above exemplary aspects of the invention that a bottle is provided with a body portion provided with a plurality of guides arranged in a spiral pattern so that liquid contents can be smoothly and stably discharged through an opening of the bottle, while spirally revolving inside the bottle.

It is another advantage of some of the above exemplary aspects of the invention to provide a bottle which can prevent liquid contents from gushing out of the bottle so that a user can safely pour or drink the liquid contents, and it is possible to prevent contamination attributable to a violent gushing of the liquid contents from occurring.

It is a further advantage of some of the above exemplary aspects of the invention to provide a bottle provided with a body portion which can be easily twisted by external force when all of the contents have been emptied, so that the volume of the bottle is reduced to the maximum.

BRIEF DESCRIPTION OF THE DRAWINGS

The above and other objects, features and advantages of various exemplary aspects of the present invention will be more clearly understood from the following detailed description when taken in conjunction with the accompanying drawings, in which.

DETAILED DESCRIPTION OF EMBODIMENTS

Figure 1:
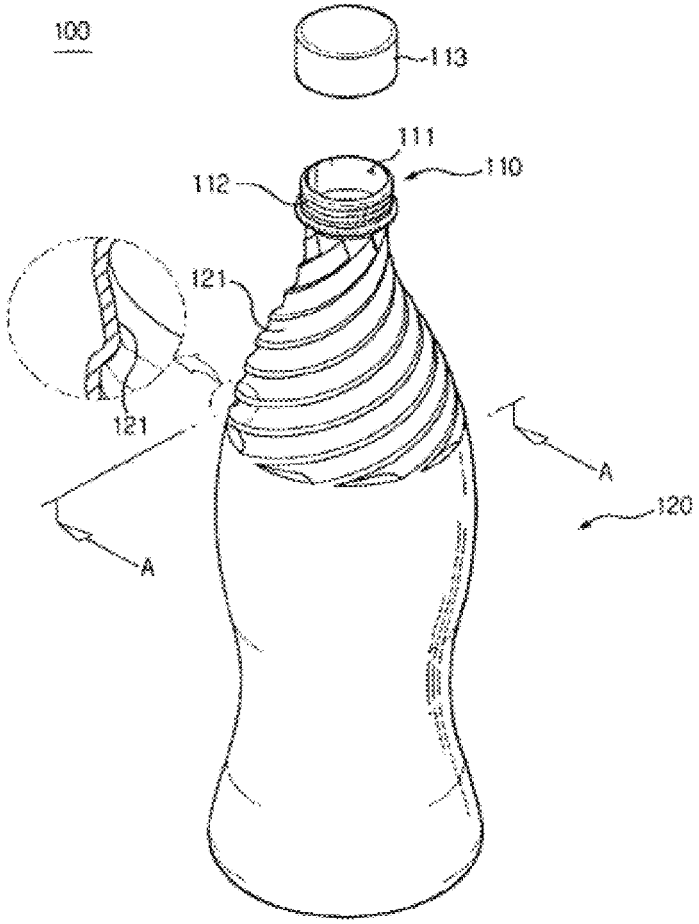
FIG. 1 is a perspective view illustrating a bottle according to one exemplary aspect of the invention.

As described above, when the user tilts a prior art bottle, the liquid contents are discharged out of the prior art bottle and gas (such as, e.g., ambient air) flows into such a bottle in order to fill a gap created by the discharged liquid contents. When the user slightly tilts the prior art bottle, the liquid contents tend to not block the opening of the bottle and gas flows into the bottle smoothly and stably. In contrary, when the user tilts the prior art bottle more and pours the liquid contents out of the prior art bottle more, the liquid contents tend to block the opening of the bottle and, as a result, the gas cannot easily flow into the bottle. As more liquid contents are discharged, the pressure inside the prior art bottle keeps decreasing. And as the pressure inside the prior art bottle decreases down to an excessive pressure, the gas gushes into the bottle due to the excessive pressure, thereby causing the liquid contents to be unstably and not smoothly discharged out of the bottle and resulting in abrupt gushing of the liquid contents.

Accordingly, various bottles of various exemplary aspects and embodiments of this invention are designed to stably and smoothly discharge liquid contents out of the bottles, thereby preventing such abrupt gushing of the liquid contents out of the bottle.

To this end, various bottles of the present invention are provided with multiple guides on their inside surfaces and allow the liquid contents to be discharged along such guides in order to prevent the liquid contents from blocking the opening. In other words, such guides can facilitate the gas to stably and smoothly flow into the interior of the bottle and to stably and smoothly fill the empty space left behind by the discharged liquid contents. Accordingly, such guides can prevent such abrupt gushing of the liquid contents.

Reference will now be made in greater detail to exemplary aspects of the invention, an example of which is illustrated in the accompanying drawings. Wherever possible, the same reference numerals will be used throughout the drawings and the description to refer to the same or like parts.

Hereinafter, exemplary aspects of the invention will be described with reference to the accompanying drawings through which like elements are referenced by like numbers. In describing the invention, details on the structure or function of related arts are omitted if they may obscure the subject of the invention.

Terms in the description are defined considering functions of elements of the invention, so that the terms must be construed with reference to the contents of the present specification as a whole because such terms can be differently defined according to the intents of people skilled in their arts or customs.

Figure 2:
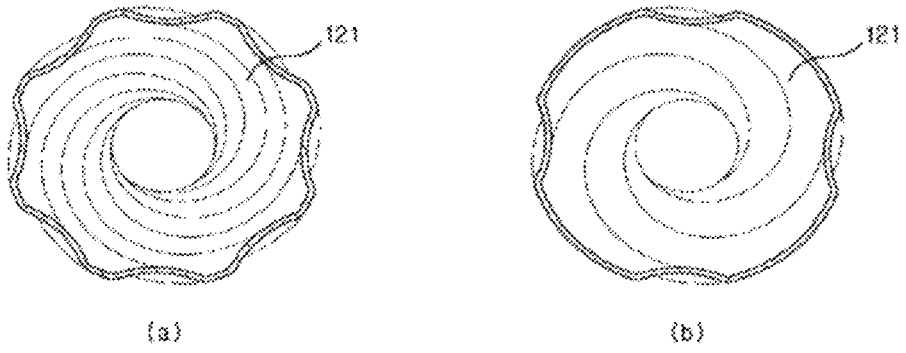
FIGS. 2A and 2B are sectional views taken along line II-II of FIG. 1.
Figure 3:
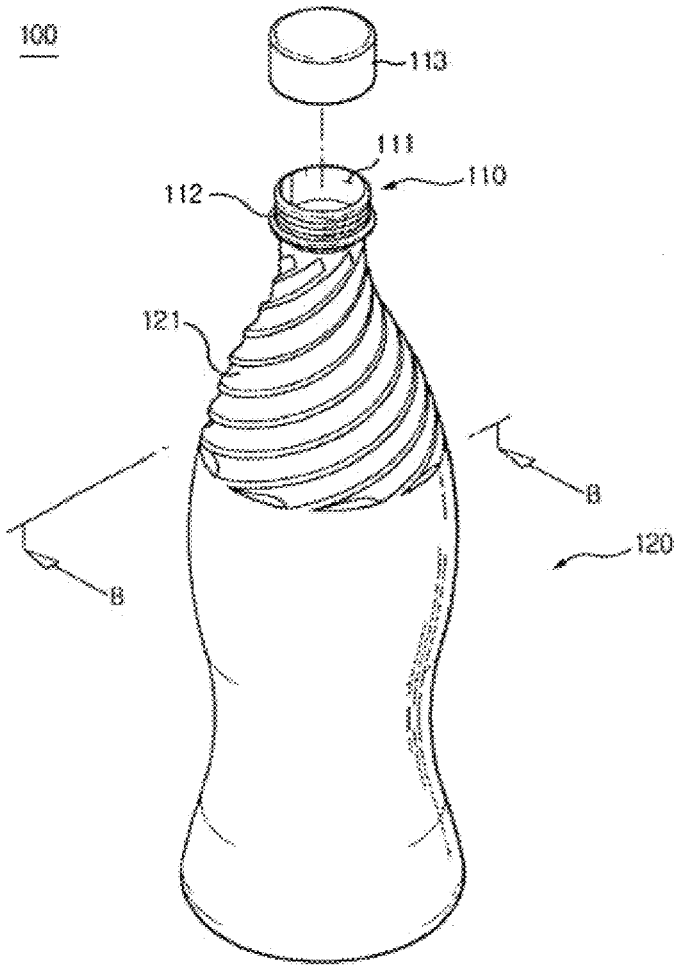
FIG. 3 is a perspective view illustrating a bottle according to another exemplary aspect of the invention.
Figure 4:
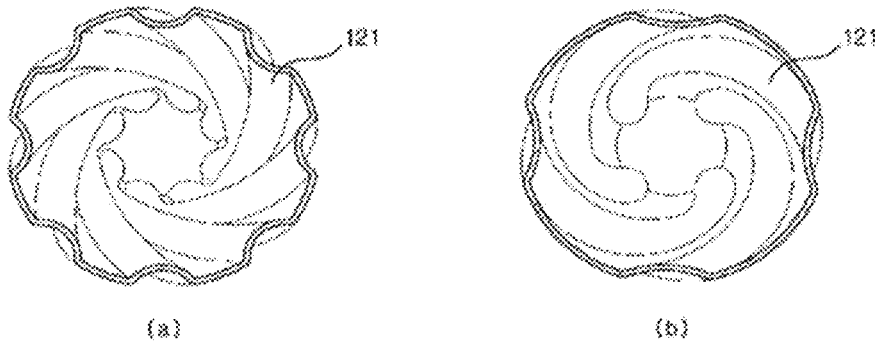
FIGS. 4A and 4B are sectional views taken along line IV-IV of FIG. 3.

FIG. 1 is a perspective view illustrating a bottle according to one exemplary aspect of the invention, FIGS. 2A and 2B are sectional views illustrating a section of the bottle taken along line II-II of FIG. 1, FIG. 3 is a perspective view illustrating a bottle according to another exemplary aspect of the invention, and FIGS. 4A and 4B are sectional views illustrating a section of the bottle taken along line IV-IV.

As shown in FIGS. 1 to 3, the bottle of the exemplary aspects of the invention includes a neck portion 110 and a body portion 120. The neck portion 110 has an opening 111 and a thread 112 to be combined with a cover 113 in a screwed manner. Alternatively, the neck portion may be combined with the cover 113 in manners different from the screwed manner for ensuring sealing of the bottle. For example, the cover 113 can be attached to or detached from the neck portion 110. The body portion 120 extends from the neck portion 110 and contains liquid contents therein.

The bottle 100 having the above-mentioned structure can contain a beverage, such as water or cola, a liquor, a saline solution, or a liquid-type food, and may be made of various materials.

The bottle 100 may be a paper bottle, a PET bottle, a metal bottle, or a glass bottle. According to the aspect of the invention, the bottle 100 may be a polyethylene terephthalate resin (PET) bottle.

As shown in the exemplary aspects of the invention in FIGS. 1 to 3, the body portion 120 takes a form in which a plurality of guides 121 is provided in a spiral pattern and protrude inwardly from the inside surface of the entire or part of an upper portion of the body portion 120 which is on the upper side of the middle of the body portion 120 in a length direction so that the liquid contents proceed toward the opening 111 of the neck portion 110 while spirally revolving inside the bottle 100 and are then discharged out of the bottle 100. With such a structure, the outer surface of the body portion 120 with the plurality of guides 121 is depressed in the form corresponding to the plurality of guides 121.

As the plurality of guides 121 is provided to the upper portion of the body portion 120 in the spiral pattern, the body portion 120 is wavelike in appearance. Further, a sectional view of the body portion 120 shows that each of the plurality of guides 121 has the shape of a letter 'C' or a reversed letter 'C.' When the section of the body portion 120 is viewed in the direction in which the contents proceed, the curvature of a leading portion is relatively loose but the curvature of the back portion is relatively tight. Alternatively, the body portion may take a form in which the curvature is maintained constant.

When the liquid flows in the above-mentioned manner, the curvature of a portion with which the liquid makes earlier contact must be relatively loose and the curvature of a portion to which the liquid contacts later must be relatively tight. The portion having the relatively tight curvature hinders the flow of the liquid primarily and then the portion having the relatively loose curvature makes the flow of the liquid slower. The border between the portion with the relatively tight curvature and the portion with the relatively loose curvature takes a streamlined shape so that the friction with the liquid is reduced. In the case in which the curvature is constant at every portion, it is also possible to attain the same advantage of controlling the speed of flow of the liquid in the above-mentioned manner.

In another exemplary aspect of the invention, the plurality of guides 121 take a form composed of four or eight spiral lines, but the form is not limited thereto. That is, the form may be composed of other than eight spiral lines. Further, the widths of the plurality of guides 121 are narrower at a relatively upper area and broader at a relatively lower area.

In another exemplary aspect of the invention, the widths of the plurality of guides 121 gradually decrease toward the upper area and increase toward the lower area, but do not change from a midpoint to the bottom of the body portion in length. Alternatively and in another exemplary aspect of the invention, the widths of the guides 121 may be uniform over their lengths.

The exemplary aspect of FIG. 1 shows the PET bottle 10 having the above-described structure. In FIG. 1, the widths of the plurality of guides 121 in a spiral pattern are uniform over their lengths. FIGS. 2A and 2B are plan views of the upper part of the body portion of the PET bottle 100, which are taken along II-II of FIG. 1 and viewed from the bottom side. FIG. 2A shows the case in which the number of guides of the plurality of guides 121 is eight, and FIG. 2B shows the case in which the number of guides of the plurality of guides 121 is four.

The exemplary aspect of FIG. 3 shows the PET bottle 100 having a form in which the widths of the plurality of guides 121 decrease toward the upper end but are gradually increased toward the middle point of the bottle from which the widths are uniform. FIGS. 4A and 4B are plan views taken along line IV-IV of FIG. 3 and viewed from the bottom side of the PET bottle 100. FIG. 4A shows the case in which the number of guides of the plurality of guides 121 is eight and FIG. 4B shows the case in which the number of guides of the plurality of guides 121 is four.

Figure 5:
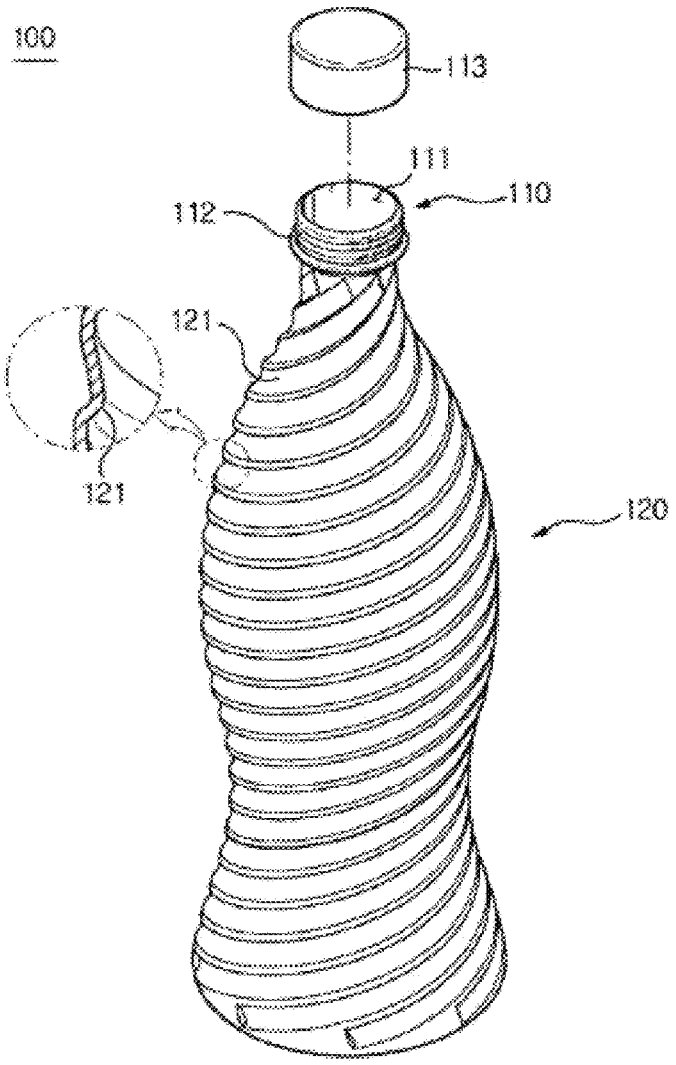
FIG. 5 is a perspective view illustrating a bottle according to a further exemplary aspect of the invention.

FIG. 5 is a perspective view illustrating a PET bottle according to another aspect of the invention. As shown in FIG. 5, the PET bottle 100 according to this aspect of the invention basically is similar in form and function to the PET bottle shown through FIGS. 1 to 4B. Accordingly, repetitive description will be omitted and only the differences therebetween will be described.

Figure 6:
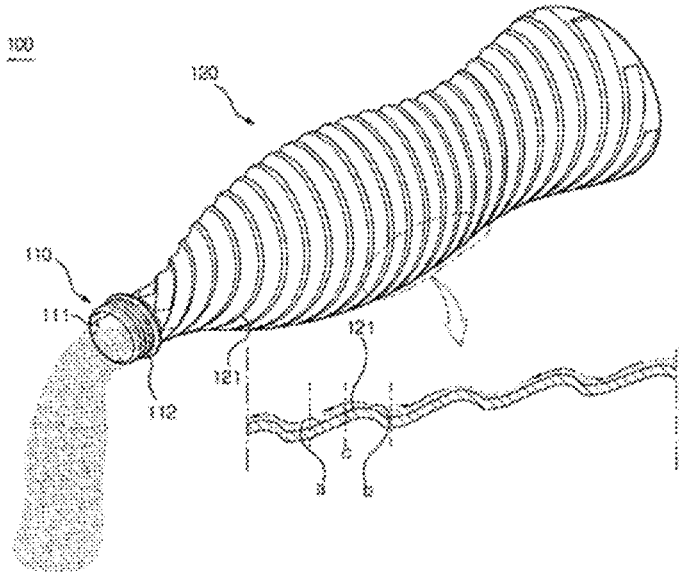
FIG. 6 is a perspective view and a section-enlarged view for explaining a curvature of a guide of the bottle.

As shown in FIG. 5, the entire body portion 120 of the PET bottle 100 has a plurality of guides 121 protruding inward from the inside surface of the body and making a spiral pattern. Accordingly, the entire body portion 120 is wavelike in appearance. FIG. 6 is a perspective view and a section-enlarged view illustrating the PET bottle 100 and for explaining the curvature of the guides 121 provided to the PET bottle 100.

Figure 7:
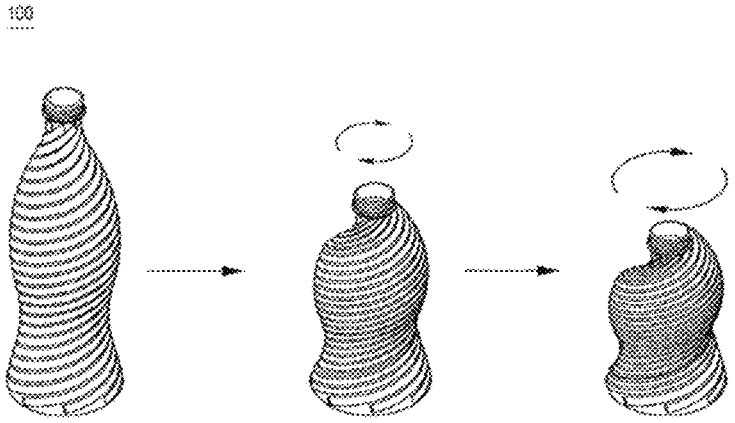
FIG. 7 is a comparative view illustrating a procedure of disposing of the bottle according to various exemplary aspects of the invention.

In another exemplary aspect of the invention and as shown in FIG. 6, when tilting and pouring the liquid contents, for example cola, in the PET bottle 100, the liquid contents revolve along the plurality of guides 121 inside the PET bottle 100 and therefore the liquid contents are discharged with uniform flow through the opening 111. As shown in FIG. 6, a curvature of a portion (b) of each guide 121 which is on the leading side of a midpoint (c) in the direction of the liquid contents flowing out is tighter than a curvature of a portion (a) which is on the back side of the center (c). That is, the portion (a) has a gentle curve and the portion (b) has a tight curve. As a result, this form prevents the liquid from being abruptly discharged. FIG. 7 is a comparative view for illustrating a procedure of disposing of the PET bottle according to the aspect of the invention.

In order to more efficiently prevent such abrupt gushing, the guides of various aspects of the present invention are preferably provided in a spiral pattern along a longitudinal axis of the bottles. As a result, the liquid contents tend to be pushed onto such guides due to centrifugal force while being discharged out of the bottle. Therefore, such spiral guides can preferentially guide the liquid contents closer to the inside surface while maintaining the opening open or unblocked by the liquid contents, thereby facilitating the creation of air paths for the ambient air during discharge.

In another exemplary aspect of the invention, some of the plurality of guides may be arranged to have asymmetrical shapes or cross-sections. In particular, each of such asymmetrical guides may be arranged to form a shallow portion and a deep portion. As a result, the deep portion may guide more liquid contents than the shallow portion. Accordingly, by arranging the asymmetrical guides in such a way that the liquid contents driven by the centrifugal force are preferentially guided by such deep portions of the guides, more liquid contents are discharged closer to the inside surface and away from a center of the longitudinal axis of the bottles while maintaining the opening open or unblocked by the liquid contents, thereby further facilitating the creation of air paths for the ambient air during discharge.

In another exemplary aspect of the invention, the PET bottle 100 is crushed and distorted by twisting and compressing along the plurality of guides 121 formed in the body portion 120 of the PET bottle 100. When a compressing force is applied to the PET bottle 100, the middle point or a border between the large-curvature portion and the small-curvature portion of each guide 121 having the letter "C" shape or the reversed letter "C" shape is folded over a portion of the length of the spiral pattern, so it is possible to reduce the volume of empty bottles. For this reason, it is possible to make recovering empty bottles easier.

Although the bottle of the invention has been described in terms of various aspects, it will be apparent to those skilled in the art that various modifications and variations may be made without departing from the spirit of the invention. Thus, the scope of the invention must be defined by the appended claims and it is intended that the present invention covers the modifications and variations of this invention.

What is claimed is:

1. A bottle for containing liquid, the bottle comprising:

a single-piece glass body comprising a base, a cap-engaging portion and a neck;

the cap-engaging portion defining an opening of the bottle and configured to engage with a bottle cap;

the neck comprising a top end and a bottom end, the top end of the neck being adjacent the cap-engaging portion;

the neck further comprising an inner surface that defines a channel between the top end and the bottom end;

the base extending from the bottom end of the neck and comprising a liquid-containing space therein; and at least one inwardly-protruded spiral guide formed on the inner surface of the neck and configured to guide at least part of liquid to spirally flow through the channel when discharging liquid from the liquid-containing space, wherein the at least one inwardly-protruded spiral guide generally spirally extends about a central axis of the bottle that passes through the channel and the liquid-containing space, wherein a cross-section of the base taken in a plane perpendicular to the central axis is generally circular and has an inner diameter, wherein the base has a level at which the inner diameter is largest, wherein the at least one inwardly-protruded spiral guide continuously extends from the top end of the neck to the base passing the level at which the inner diameter is largest.

2. The bottle of claim 1, wherein the inner surface of the neck with the at least one inwardly-protruded spiral guide includes a general shape of a letter "C" or a reversed letter "C" in a cross-section taken in a plane parallel to the central axis.

3. The bottle of claim 1, wherein the at least one inwardly-protruded spiral guide extends circumferentially about the central axis about 180° or more.

4. An article comprising:

the bottle of claim 3; and liquid contained in the liquid-containing space of the base.

5. A method of discharging liquid contained in a bottle, the method comprising:

providing the article of claim 4;

tilting the bottle to discharge at least part of the liquid out of the bottle;

wherein the at least one inwardly-protruding spiral guide causes at least part of the liquid to at least in part spirally flow along the at least one inwardly-protruded spiral guide when passing through the channel.

6. The bottle of claim 1, wherein the at least one inwardly-protruded spiral guide extends circumferentially about the central axis about 270° or more.

7. The bottle of claim 1, wherein the at least one inwardly-protruded spiral guide extends circumferentially about the central axis about 360° or more.

8. The bottle of claim 1, wherein in a cross-section taken in a plane parallel to the central axis, the at least one inwardly-protruded prial guide provides multiple peaks and multiple valleys, which comprise a leading valley, a trailing valley and a first peak interposed between the leading valley and trailing valley, the trailing valley being located closer to the base than the leading valley, there being no intervening peak or valley between the first peak and the leading valley, there being no intervening peak or valley between the first peak and the trailing valley, wherein in the cross-section, the first peak is defined with a leading slope, a trailing slope and a tip connecting the leading and trailing slopes, the leading slope being defined between the tip of the first peak and the bottom of the leading valley, the trailing slope being defined between the tip of the first peak and the bottom of the trailing valley, wherein in the cross-section the leading slope is longer than the trailing slope.

9. The bottle of claim 8, wherein the at least one inwardly-protruded spiral guide extends circumferentially about the central axis about 270° or more.

10. The bottle of claim 8, wherein the at least one inwardly-protruded spiral guide extends circumferentially about the central axis about 360° or more.

11. The bottle of claim 1, wherein in a cross-section taken in a plane parallel to the central axis, the at least one inwardly-protruded spiral guide provides multiple peaks and multiple valleys, wherein in the cross-section, the first peak is defined with a leading slope and a trailing sloop, the trailing slope being closer to the base than the leading slope, the leading slope comprising a portion generally defined with a first radius of curvature, the trailing slope comprising a portion generally defined with a second radius of curvature, wherein in the cross-section the first radius of curvature is greater than the second radius of curvature.

12. The bottle of claim 11, wherein the at least one inwardly-protruded spiral guide extends circumferentially about the central axis about 180° or more.

13. The bottle of claim 11, wherein the at least one inwardly-protruded spiral guide extends circumferentially about the central axis about 270° or more.

14. A method of discharging liquid contained in a bottle, the method comprising:

providing the bottle of claim 11, in which liquid is contained, wherein the bottle comprising an opening at the top end;

tilting the bottle to discharge at least part of the liquid out of the bottle through the opening;

wherein the at least one inwardly-protruded spiral guide causes at least part of the liquid to at least in part spirally flow along the at least one inwardly-protruded spiral guide when passing through the channel, wherein the liquid being discharged does not block the opening such that ambient air flows into the bottle, which facilitates discharging of the liquid out of the bottle.

15. The method of claim 14, wherein as the liquid is discharged out of the bottle, vapor pressure inside the bottle decreases, which in turn causes ambient air to flow into the bottle, which further facilitates discharging of the liquid out of the bottle.

16. The method of claim 14, wherein the spirally flowing liquid forms an air path inside the neck of the bottle.

17. The bottle of claim 1, wherein the single-piece glass body further comprises a rim at the top end of the neck, wherein the at least one inwardly-protruded spiral guide extends between the top end and the bottom end.

18. The bottle of claim 1, wherein in a cross-section taken in a plane parallel to the central axis the at least one inwardly-protruded spiral guide provides multiple peaks and multiple valleys, wherein two immediately neighboring ones of the multiple peaks have a generally uniform distance.

19. The bottle of claim 1, wherein the at least one inwardly-protruded spiral guide comprises two immediately neighboring peaks that generally spirally extend with a gap therebetween, wherein the gap is maintained generally uniformly over the extension thereof.

20. The bottle of claim 1, wherein the at least one inwardly-protruded spiral guide is recognizable in a perspective view of the glass body from the outside.

21. The bottle of claim 1, wherein the neck comprises an outer surface and at least one depression on the outer surface that spirally extends and corresponds to the at least one inwardly protruded spiral guide.

22. The bottle of claim 1, wherein with the presence of the at least one inwardly-protruded spiral guide, the neck comprises an undulating cross-sectional portion when the cross-section is taken in a plane parallel to the central axis.

23. The bottle of claim 1, wherein a cross-section of the base taken in a plane perpendicular to the central axis is generally in a circular shape and has an inner diameter, wherein the base has a level at which the inner diameter is the largest, wherein the at least one inwardly-protruded spiral guide does not extend to the level at which the inner diameter is the largest.

24. The bottle of claim 23, wherein the base comprises a portion in which the inner diameter of a cross-section of the base gradually increases along the central axis away from the neck.

* * * * *